US005501750A

United States Patent [19]

Smith et al.

[11] Patent Number: 5,501,750

[45] Date of Patent: Mar. 26, 1996

[54] WICK COMPOSITIONS FOR INCENDIARY DEVICES

[76] Inventors: Richard E. Smith, 4649 Lilac, Glenview, Ill. 60025; C. James Dahn, 400 N. Wheeling Rd., Prospect Heights, Ill. 60070

[21] Appl. No.: 370,702

[22] Filed: Jan. 10, 1995

[51] Int. Cl.[6] ..... C06B 45/00

[52] U.S. Cl. ..... 149/2; 149/109.6; 431/325

[58] Field of Search ..... 149/2, 109.6, 46, 149/94, 96; 431/325; 44/519

[56] References Cited

U.S. PATENT DOCUMENTS

| | | | |
|---|---|---|---|
| 224,203 | 2/1880 | McCormick | 431/325 |
| 1,430,543 | 4/1919 | Grosvenor | 431/287 |
| 3,056,701 | 10/1962 | Fritzlen | 149/15 |
| 3,940,233 | 2/1976 | Fox et al. | 431/325 |
| 4,189,305 | 2/1980 | Clayton | 44/41 |

*Primary Examiner*—Donald P. Walsh
*Assistant Examiner*—Anthony R. Chi
*Attorney, Agent, or Firm*—McDermott, Will & Emery

[57] ABSTRACT

A wick composition for incendiary devices is disclosed which enables an improved and controlled burn rate. The wick composition comprises:

(a) about 25 to about 75 weight percent of a nitrate compound selected from the group consisting of cellulose nitrate, cellulose trinitrate, polyvinyl nitrate, and ammonium nitrate;

(b) a nitrate stabilizer; and (c) a wick or string material.

10 Claims, No Drawings

WICK COMPOSITIONS FOR INCENDIARY DEVICES

FIELD OF THE INVENTION

This invention relates to improved wick compositions for incendiary devices such as candles. More particularly, this invention relates to wick compositions for incendiary devices which enable improved and controlled burn rates.

BACKGROUND OF THE INVENTION

Compositions for incendiary devices are well known in the art. For example, in McCormick, U.S. Pat. No. 224,203, a lamp wick saturated in a solution of nitrate of potash and alum is disclosed. In Haase, U.S. Pat. No. 807,553, a method is disclosed for facilitating lighting of candles and tapers made of stearin, wax, paraffin or other suitable material. The method comprises dipping the free end of the wick material, which will not be embedded in the candle substance, in a solution of celluloid in acetone.

In Grosvenor et al., U.S. Pat. No. 1,430,543, a lighter wick is disclosed for cigars, cigarettes, and pipes in which a suitable "tow wick" is made with an adjusted quality and quantity of fat material. An oxidizing agent which may include nitrates and chlorates is disclosed to promote combustion.

In Fox et al., U.S. Pat. No. 3,940,233, a lead-free candle composition is disclosed which comprises a combustible wick composition comprising a combustible wick and a stiffening agent. The stiffening agent comprises a wax-insoluble polymer or copolymer having a Vicat softening point of at least 2.5° C. higher than the melting point of the candle wax. Examples of suitable stiffening agents mentioned include polyacrylates, polymethacrylates, polystyrenes, styrene-acrylate copolymers, styrene-methacrylate copolymers, nitrocellulose and derivatives thereof. Polymethylmethacrylate and polystyrene are mentioned as being excellently suited as the stiffening agents. The Fox et al. candle compositions comprise about 75–95 weight percent of a wicking material and 5–25 weight percent of a stiffening agent.

The problem with many of the prior art compositions for incendiary devices is that the compositions result in the emission of harmful or noxious gases. Further, many prior art compositions do not enable a controlled burning of the wick of the candle or other incendiary device. It would therefore be advantageous to provide a composition for incendiary devices which would burn completely at a controlled burn rate with no harmful gases being emitted during or after burning.

SUMMARY OF THE INVENTION

The invention comprises a wick composition for incendiary devices which enables an improved and controlled burn rate comprising:

(a) about 25 to about 75 weight percent of a nitrate compound selected from the group consisting of cellulose nitrate, cellulose trinitrate, polyvinyl nitrate, and ammonium nitrate;

(b) a nitrate stabilizer; and (c) a wick or string material.

The wick or string material may comprise linen, rayon, cotton, or cellulose or mixtures thereof. Optionally, the wick compositions may additionally comprise a material to give the wick composition pliability or flexibility which may be desirable depending on the application of the wick composition. Such pliable materials include naphthalene, camphor, or other suitable cross-linked polymers such as polyethylene. The invention further comprises methods of making such wick compositions for incendiary devices.

The wick compositions of the invention are especially suitable for lighting an incendiary device comprising a series of candles such as birthday cake candles linked together in series by the wick composition.

DETAILED DESCRIPTION OF THE INVENTION

The wick compositions of the invention for incendiary devices having improved and controlled burn rates comprise: (a) a nitrate compound selected from the group consisting of cellulose nitrate, cellulose trinitrate, polyvinyl nitrate, and ammonium nitrate; (b) a nitrate stabilizer, and (c) a wick or string material. The wick or string material preferably comprises rayon, linen, cotton, cellulose, or a mixture thereof. Optionally, a pliable material such as camphor, naphthalene, or a suitable cross-linked polymer such as polyethylene may be added if needed to make the wick composition more pliable or flexible.

The nitrate compound contained in the wick compositions of the invention is selected from the group consisting of cellulose nitrate, cellulose trinitrate, polyvinyl nitrate, and ammonium nitrate, such as a commercially available nitrocellulose sold under the designation Hercules Nitrocellulose RS18-25-SEC, available from Hercules Chemical Co., Wilmington, Del. The nitrate compound comprises about 25 to about 75 weight percent of the wick composition, and preferably about 40 to about 70 weight percent of the wick composition. Also, preferably the nitrate compound comprises about 12 to about 13.5% nitrogen.

The nitrate stabilizer is preferably selected from the group consisting of dibutyl phthalate, diphenylamine, and ethyl centralite. Preferably the nitrate stabilizer comprises ethyl centralite such as an ethyl centralite which is commercially available under the designation 1,3-diethyl-1,3-diphenylurea from Aldrich Chemical Company, Milwaukee, Wis. The nitrate stabilizer preferably comprises about 0.1 to about 5.0 weight percent of the composition, and most preferably comprises about 0.1 to about 1.0 weight percent of the composition.

The wick composition of the invention further comprises a wick or string material. Preferably the wick or string material is selected from the group consisting of linen, rayon, cotton, cellulose or mixtures thereof. Most preferably, the wick or string material comprises linen, rayon, or a mixture thereof. In one preferred embodiment, the wick composition used in the invention comprises a multi-filament linen or rayon yarn. Examples of wick or string material according to the invention include but are not limited to multi-filament rayon yarns available from North American Rayon Corporation, Elizabethton, Tenn. Two such yarns are sold under manufacturing codes 4321 and 4324, and both have a denier size of about 150, about 60 filaments per yarn, and about 3 turns or twists per yarn. Another example of a suitable wick or string material according to the invention is a multi-filament rayon yarn manufactured by Dixie Yarns, Inc. of Gastonia, N.C. sold under the manufacturing code 12/2 Rayon Lot No. 885SJ. This yarn has a denier size of 60, about 738 fibers per cross-section, and a twist of ply 9.0. The wick or string material comprises about 25 to about 75 weight percent of the wick composition, and preferably about 30 to about 60 weight percent of the wick composition.

The wick compositions of the invention are made by forming a nitrate solution by dissolving the nitrate compound in a suitable solvent and mixing the dissolved nitrate compound with a nitrate stabilizer. The wick or string material is then passed through the nitrate solution to form a wick material coated and impregnated with the nitrate solution. The nitrate solution is then dried.

For example, the nitrate compound and the nitrate stabilizer are dissolved in a suitable solvent for the nitrate compound. Such solvents are well known in the art and include, for example, ethyl acetate, alcohol/ether, acetone, ethylene glycol acetate, methoxybutanol acetate ketones, methanol, or an inorganic hydroxide. The dissolved nitrate compound is then mixed with a nitrate stabilizer to form a nitrate solution. The nitrate solution is then inserted or impregnated into the wick or string material by any suitable method such as by passing the wick or string material through the nitrate solution by methods which are well known in the art. Such methods include, for example, placing the nitrate solution in a coating chamber and pulling the string or wick material through the chamber. Alternatively, the string may be dipped into the nitrate solution. The nitrate solution may be worked and impregnated into the string or wick material by spreading the fibers or monofilaments of the string or wick material by conventional means and pulling the string or wick material through the nitrate solution. Such impregnation methods are described, for example, in U.S. Pat. Nos. 3,042,570 and 5,019,450, incorporated herein by reference, which relate to impregnation of fiber reinforcing materials such as glass fibers with thermoplastic resins for long fiber thermoplastics.

The compositions of the invention may additionally comprise a pliable material such as naphthalene, camphor, or other suitable cross-linked polymers such as polyethylene. The following examples further illustrate the wick compositions of the invention.

EXAMPLE 1

A wick composition was prepared comprising 25.0 wt. % cellulose nitrate (12% nitrogen), 0.3 wt. % ethyl centralite as a stabilizer, and 74.7 wt. % of either of the North American Rayon multi-filament rayon yarn 4321 or 4324. The cellulose nitrate was first mixed with acetone until it was in liquid phase and mixed with the ethyl centralite. The rayon wick material was then passed through the liquid cellulose nitrate solution and dried either by forced air (convective) or vacuum drying at 80° C. The burn rate (inch/second) of this wick composition was approximately 0.42.

EXAMPLE 2

A wick composition was made according to Example 1 except that 50.0 wt. % cellulose nitrate (12% nitrogen), 0.5 wt. % ethyl centralite, 48.5 wt. % of a multi-filament yarn described in Example 1, and 1.0 wt. % naphthalene was used. The burn rate (inch/second) of this composition was approximately 0.93.

EXAMPLE 3

A wick composition was made according to Example 1 except that 74.0 wt. % cellulose nitrate (12% nitrogen), 0.7 wt. % ethyl centralite, and 25.3 wt. % multi-filament rayon yarn described in Example 1 was used. The burn rate (inch/second) of this composition was approximately 1.30.

As can be seen in Table I below, the burn rate of the compositions of the invention can be controlled by the amount of nitrate compound added to the wick material. In Table I, all wick compositions were made according to Example 1, and only the amount of cellulose nitrate to the amount of wick material was varied.

TABLE I

| % Cellulose Nitrate in Coated Wick | Wick Burn Rate (inch/sec) |
|---|---|
| 26.0 | 0.42 |
| 58.8 | 0.93 |
| 68.0 | 1.10 |
| 74.0 | 1.30 |
| 78.0 | 1.10 |

EXAMPLE 4

An incendiary device comprising a group of birthday candles linked together in series was prepared from the wick composition of Example 2. The standard wicks of about thirty-five candles were attached to a suitable length of the wick composition so that all standard candle wicks were linked to one another in a series, each candle being a distance of about one to three inches apart. The attachment of the wick composition to the standard candle wicks was made by solvent gluing each standard candle wick to the wick composition with the wick composition solvent (acetone). However, attachment of the wick composition to the standard candle wicks can be accomplished by any other suitable means such as with a suitable adhesive or by ultrasonic welding. The series of birthday candles were lit by simply igniting one end of the wick composition attached to the wick of the first or last candle in the series.

The advantages of the wick compositions for incendiary devices of the invention include that the incendiary devices using the wick compositions of the invention, when lit, will burn completely without residue and will produce no harmful gases. Further, the incendiary devices made from the compositions of the invention may be used to light a single incendiary device such as a candle, or may be used in series to light multiple candles or incendiary devices. For example, the compositions of the invention can be used to ignite multiple birthday or holiday candles linked together in a series by said wick composition. The speed of burning can be controlled as described above, depending on the amount of nitrate compound used.

What is claimed is:

1. A wick composition for incendiary devices having a controlled burn rate comprising:

(a) about 25 to about 75 weight percent of a nitrate compound selected from the group consisting of cellulose nitrate, cellulose trinitrate, polyvinyl nitrate, and ammonium nitrate;

(b) a nitrate stabilizer; and (c) a wick or string material.

2. The wick composition of claim 1 wherein the wick or string material is selected from the group consisting of linen, rayon, cotton, cellulose or mixtures thereof.

3. The wick composition of claim 2 wherein the wick or string material comprises linen, rayon or a mixture thereof.

4. The wick composition of claim 1 further comprising a pliable material selected from the group consisting of camphor, naphthalene, and polyethylene or mixtures thereof.

5. The wick composition of claim 1 wherein the nitrate stabilizer is selected from the group consisting of dibutyl phthalate, diphenylamine, and ethyl centralite.

6. The wick composition of claim 1 wherein the incendiary device is a series of candles linked together by said wick composition in series.

7. The wick composition of claim 1 wherein the nitrate stabilizer comprises about 0.1 to about 5.0 weight percent of the wick composition.

8. A coated wick or string for an incendiary device having a controlled burn rate comprising:

(a) about 25 to about 75 weight percent of a nitrate compound selected from the group consisting of cellulose nitrate, cellulose trinitrate, polyvinyl nitrate, and ammonium nitrate;

(b) about 0.1 to about 5.0 weight percent of a nitrate stabilizer;

(c) about 25 to about 75 weight percent of a wick or string comprising linen, rayon, or a mixture thereof; and (d) optionally, a pliable material selected from the group consisting of camphor, naphthalene, polyethylene or mixtures thereof.

9. A method of making a wick or string for an incendiary device having a controlled burn rate, said method comprising:

(a) forming a nitrate solution by dissolving a nitrate compound selected from the group consisting of cellulose nitrate, cellulose trinitrate, polyvinyl nitrate, and ammonium nitrate in a suitable solvent and mixing the dissolved nitrate compound with a nitrate stabilizer;

(b) passing a wick or string material through said nitrate solution to form a wick material coated and impregnated with said nitrate solution; and (c) drying said coated and impregnated wick material;

wherein said nitrate compound comprises about 25 to about 75 weight percent of the said wick composition.

10. The method of claim 9 wherein the wick or string material is selected from the group consisting of linen, rayon, cotton, cellulose, and mixtures thereof.

* * * * *